US006814360B2

(12) United States Patent
Kiniry et al.

(10) Patent No.: US 6,814,360 B2
(45) Date of Patent: Nov. 9, 2004

(54) SNOWSHOE BINDING

(75) Inventors: Daniel P. Kiniry, Barre Town, VT (US); Francis E. Mahoney, Barre Town, VT (US)

(73) Assignee: K2 Snowshoes, Inc., Calsbad, CA (US)

( * ) Notice: Subject to any disclaimer, the term of this patent is extended or adjusted under 35 U.S.C. 154(b) by 239 days.

(21) Appl. No.: 10/094,523

(22) Filed: Mar. 11, 2002

(65) Prior Publication Data

US 2003/0167657 A1 Sep. 11, 2003

(51) Int. Cl.[7] ..... A63C 1/02; A43B 5/04

(52) U.S. Cl. ..... 280/11.3; 280/600; 36/122

(58) Field of Search ..... 36/122, 124, 125; 280/11.3, 600; D21/768

(56) References Cited

U.S. PATENT DOCUMENTS 1,747,213 A * 2/1930 Bates ..... 36/125
2,420,261 A * 5/1947 Nadeau ..... 36/125
2,619,742 A * 12/1952 Cumming ..... 36/125
5,740,621 A 4/1998 Wing et al.
5,787,612 A * 8/1998 Mahoney et al. ..... 36/124
5,836,093 A 11/1998 Gallay
5,881,477 A * 3/1999 Watson ..... 36/122
5,918,387 A 7/1999 Emerson
6,178,666 B1 * 1/2001 Kiniry et al. ..... 36/125
6,363,628 B1 4/2002 Mahon et al.
6,526,629 B1 3/2003 Warner et al.
6,694,646 B2 * 2/2004 Messmer et al. ..... 36/122
2003/0101623 A1 * 6/2003 Settelmayer ..... 36/124
2003/0126766 A1 * 7/2003 Messmer et al. ..... 36/122

* cited by examiner

*Primary Examiner*—Bryan Fischmann
(74) *Attorney, Agent, or Firm*—McCormick, Paulding & Huber LLP

(57) ABSTRACT

A snowshoe binding has a body member which is molded from an elastomeric synthetic material which easily conforms to the contour of a wide range of boot configurations and incorporates a pair of ladder cinch buckles mounted on synthetic straps positioned over the instep of the boot, the buckles not being anchored to any supporting component on the body member and operating in opposite directions, the straps being permanently installed in the buckles, and secured against removal from the buckles by the placement of snap hardware on the straps.

8 Claims, 7 Drawing Sheets

SNOWSHOE BINDING

BACKGROUND OF THE INVENTION

1. Field of the Invention

The invention relates to a binding for releasably securing the booted foot of a user to a snowshoe.

2. Description of Related Art

Archeologists have determined that the snowshoe has existed for several thousand years. The primary use of earlier snowshoes was utilitarian in nature for hunting, trapping, forestry and the like.

Over the past several years, snowshoeing has become a family recreational activity. Recreational users have a need: a) to adapt the snowshoes to a wide variety of footwear styles and sizes; b) to mount and dismount snowshoes frequently and easily; and 3) to gain better control of the snowshoe.

The design challenge has been to provide a versatile binding which has good control characteristics, has a wide boot style/size range, is lightweight and has ease of entry/exit, all at a low cost.

Existing bindings are of the harness type or molded type, each of which is deficient in one or more of the following respects:

harness bindings are cumbersome to mount, offer minimal control, have multiple tightening points, have components which stretch and loosen with use and require straps to be threaded through buckles each use, which is awkward; and molded bindings have limited fit range, have multiple tightening points, require straps to be threaded through buckles, which is awkward, have multiple exit releases, and are costly.

BRIEF SUMMARY OF THE INVENTION

The binding of the invention incorporates the versatility and fit range characteristics of a harness design, as well as the control advantages of a molded binding system. The binding body is molded from an elastomeric synthetic material, which easily conforms to the contour of a wide range of boot configurations. When the binding is tightened, using a natural ergonomic motion, the boot becomes securely locked in place. The design objectives of control, ease of entry/exit, lightweight and low cost are all met.

The unique feature of the design is a floating dual buckle means, which "floats" on a pair of synthetic straps, and is positioned in an area over the instep of the foot. The dual buckle means has two ladder cinch buckles, which operate in opposite directions of up to 180°. The straps are permanently installed in the buckles, and are secured against removal from the buckles by the placement of snap hardware on the straps.

The binding is easily opened by placing the fingers under tabs on each of the buckles, and lifting upwardly. The boot is then placed in the binding, with the ball of the foot lined up with alignment means on the binding. The user pulls upwardly on the two straps to tighten the fit, and then pulls downwardly to lock the binding. A heel strap is then pulled snug, and held by a cam buckle. Exit is achieved by placing the fingers under the tabs and lifting upwardly in motions which are very similar to the tying of shoes.

The improvement lies in the design of the floating buckle system, which may be constructed of currently available commercially purchased components, or which may be molded as a single component. No other known system uses opposing buckles, which are not anchored to any supporting component.

DETAILED DESCRIPTION OF THE INVENTION

Figure 1:
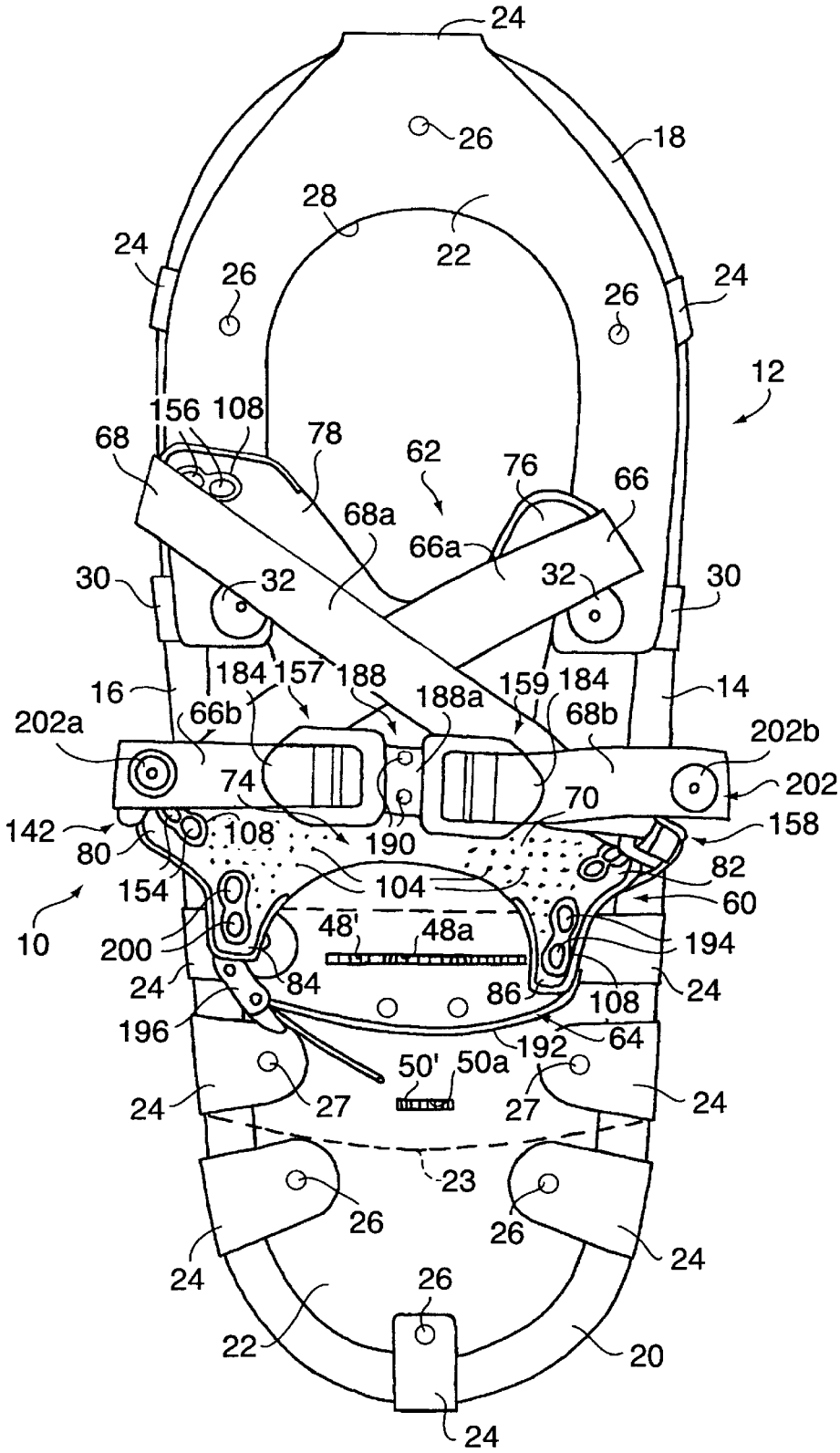
FIG. 1 is a top plan view of a snowshoe incorporating a binding embodying the invention, the binding instep straps being shown in an unengaged or unsnapped condition.

The snowshoe binding of the invention is generally indicated by 10 and is mounted relative to a snowshoe frame, generally indicated by 12, of the usual open rectangular shape in top plan, which may be fabricated from wood, metal or plastic.

Snowshoe frame 12 includes a pair of spaced, generally parallel, tubular, side rails 14 and 16 which are joined in known manner at their extremities by curved forward and rearward ends 18 and 20 respectively.

Decking 22, which is preferably fabricated from any strong, resilient plastic material, is disposed within the interior of frame 12 and is attached to the frame as by straps 24 which partially encircle the frame side rails, the straps being fixed in place as by rivets 26 or the like.

An opening 28 is provided in a forward portion of decking 22 to permit pivotal movement of snowshoe binding 10 relative to the decking and frame, the binding being fixed to a resilient pivot strap 30 disposed therebelow so as to be positioned below the ball of the foot of a user. Pivot strap 30 extends transversely between and partially encircles side rails 14 and 16 at its opposite ends, the strap ends being secured in place by rivets 32 which extend therethrough and through decking 22.

Figure 2:
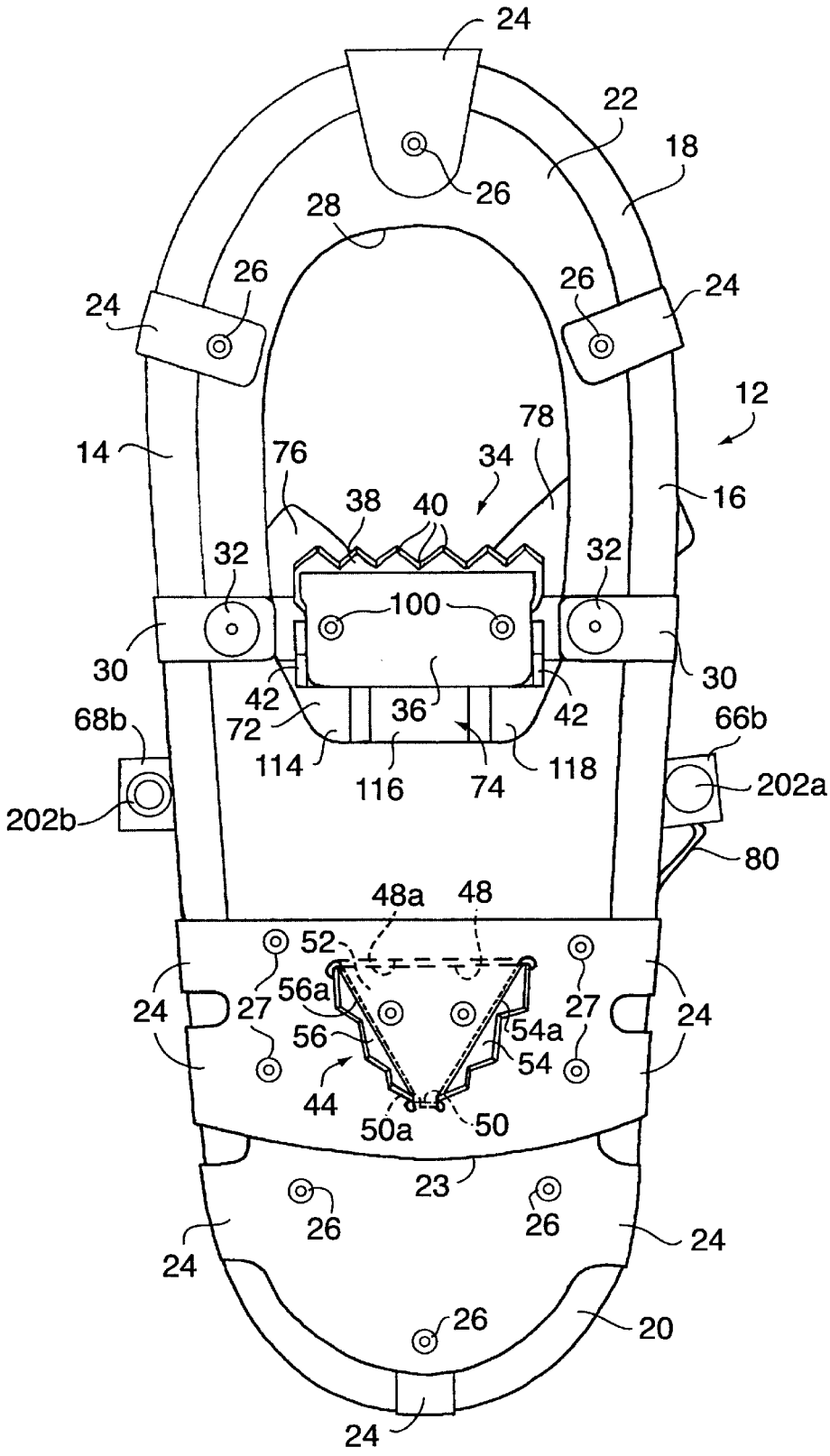
FIG. 2 is a bottom plan view of the snowshoe of FIG. 1.

As best seen in FIG. 2, a toe crampon, generally indicated by 34, is fixed to and depends centrally from the lower face of pivot strap 30.

Toe crampon 34 includes a horizontal main wall 36 and an integral forward wall 38 which extends angularly downwardly and outwardly therefrom. Forward wall has a serrated lower edge formed by a plurality of spaced, downwardly extending triangular teeth 40.

Main wall 36 also has a pair of spaced, vertically disposed teeth 42 formed integrally therewith which depend from each end thereof.

As best seen in FIGS. 1 and 2, a heel crampon, generally indicated by 44, is located on the longitudinal central axis of the snowshoe rearwardly of toe crampon 34.

Heel crampon 44 is sandwiched between decking 22 and a reinforcing member 23, which is preferably fabricated from any strong, resilient plastic material, and which extends transversely between frame side rails 14 and 16 below the decking.

Reinforcing member 23 is fixed to the decking as by rivets 27 which extend through straps 24, through the decking and through the reinforcing member.

Heel crampon 44 is substantially triangular in shape in plan and includes a pair of spaced, parallel, transversely extending, vertically disposed forward and rearward walls 48 and 50 respectively each of which have serrated upper edges 48' and 50' respectively which extend upwardly through and outwardly of spaced parallel openings 48*a* and 50*a* respectively in decking 22 so as to be engageable by the heel of the boot of a user, thereby effectively preventing boot slipage.

Walls 48 and 50 of heel crampon 44 are interconnected by a horizontally extending, triangular main wall 52 disposed between decking 22 and reinforcing member 23.

Main wall 52 has a pair of toothed side walls 54 and 56 extending angularly downwardly and outwardly therefrom through provided openings 54*a* and 56*a* respectively in reinforcing member 23.

Toe crampon 34 and heel crampon 44 impart added traction and stability to the snowshoe, as is known.

Binding 10 is a self-contained unit which includes a body member, generally indicated by 60, a unitary, combination toe strap/instep strap assembly, generally indicated by 62, and a heel strap assembly, generally indicated by 64.

Referring now to FIGS. 6–9, body member 60 of binding 10 is molded from an elastomeric, synthetic material, and includes substantially flat upper and lower planar faces 70 and 72 respectively, and a substantially rectangular central support area 74 from which emanate: a pair of spaced, first and second toe strap anchor supports 76 and 78 respectively; a pair of spaced, first and second instep strap anchor supports 80 and 82 respectively; and a pair of first and second spaced heel strap anchor supports 84 and 86 respectively.

First toe strap anchor support 76 is formed integrally on the outer end of a first finger-like member 88 and second toe strap anchor support 78 is formed integrally on the outer end of a second finger-like member 90, with each finger-like member curving angularly outwardly and upwardly from a side edge of central support area 74 adjacent an upper edge thereof.

First instep strap anchor support 80 and first heel strap anchor support 84 are formed integrally on the outer end of a first leg-like member 92 and second instep strap anchor support 82 and second heel strap anchor support 86 are formed integrally on the outer end of a second leg-like member 94, with each leg-like member extending angularly outwardly and downwardly from a side edge of central support area 74 adjacent a lower edge thereof.

A plurality of depressions and projections are molded into upper planar face 70 and lower planar face 72 of body member 60, and a plurality of openings extend vertically through body member 60, as indicated herefollowing.

A pair of spaced, aligned, circular depressions 96 is molded into upper planar face 70 of central support area 74 adjacent its upper edge, the depressions each having a centrally located opening 98 which extends vertically through body member 60.

Depressions 96 and through openings 98 are of appropriate size to accept fastening means for attaching body member 60 and binding 10 to pivot strap 30 and toe crampon 34, as will appear.

A plurality of spaced, integrally molded, frusto-conical, anti-slip pins 102 extend upwardly from upper planar face 70 of central support area 74 and are so positioned that, when the binding is in use, the anti-slip pins underlie the sole of the boot of the snowshoe user to effectively preclude boot slippage.

Other groupings of smaller integrally-molded, frusto-conical, smaller, anti-slip pins 104 extend upwardly from upper planar face 70 at each of the finger-like members 88 and 90 and leg-like members 92 and 94 and are so positioned that, when binding 10 is moved to a use position, anti-slip pins 104 will contact the sides of the boot of a snowshoe user to effectively preclude boot slippage.

Figure 8:
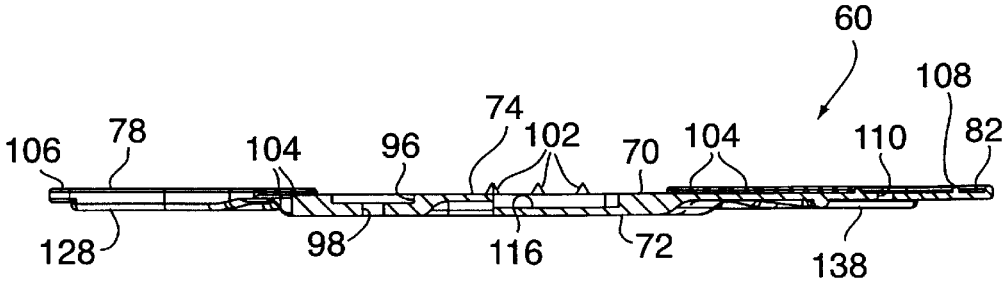
FIG. 8 is a cross sectional view taken on line 8—8 of FIG. 6.
Figure 9:
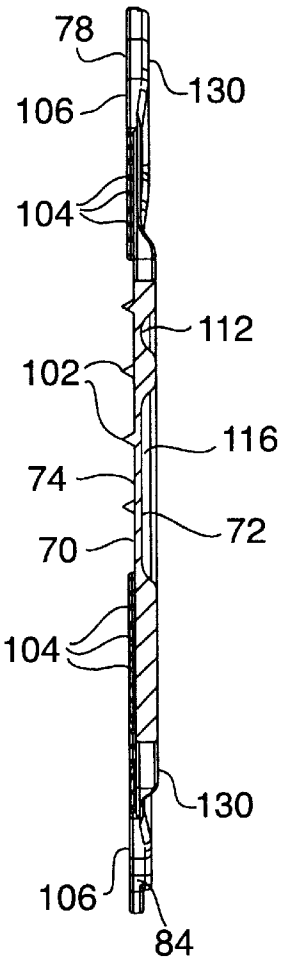
FIG. 9 is a cross sectional view taken on line 9—9 of FIG. 6.

Each toe strap anchor support 76, 78, instep strap anchor support 80, 82 and heel strap anchor support 84, 86 is provided on its upper planar face 70 with an integrally-molded, upstanding peripheral rib 106 for adding strength and rigidity to those components, and is provided with an upstanding central rib 108 in the shape of a FIG. 8, with each loop of the FIG. 8 having a centrally-located opening 110 therein which extends vertically through the respective anchor supports and body member 60.

The areas defined by each central rib 108 will accommodate fastening means for securing the toe strap/instep strap assembly 62 and the heel strap assembly 64 to their respective anchor supports, as will appear.

Figure 7:
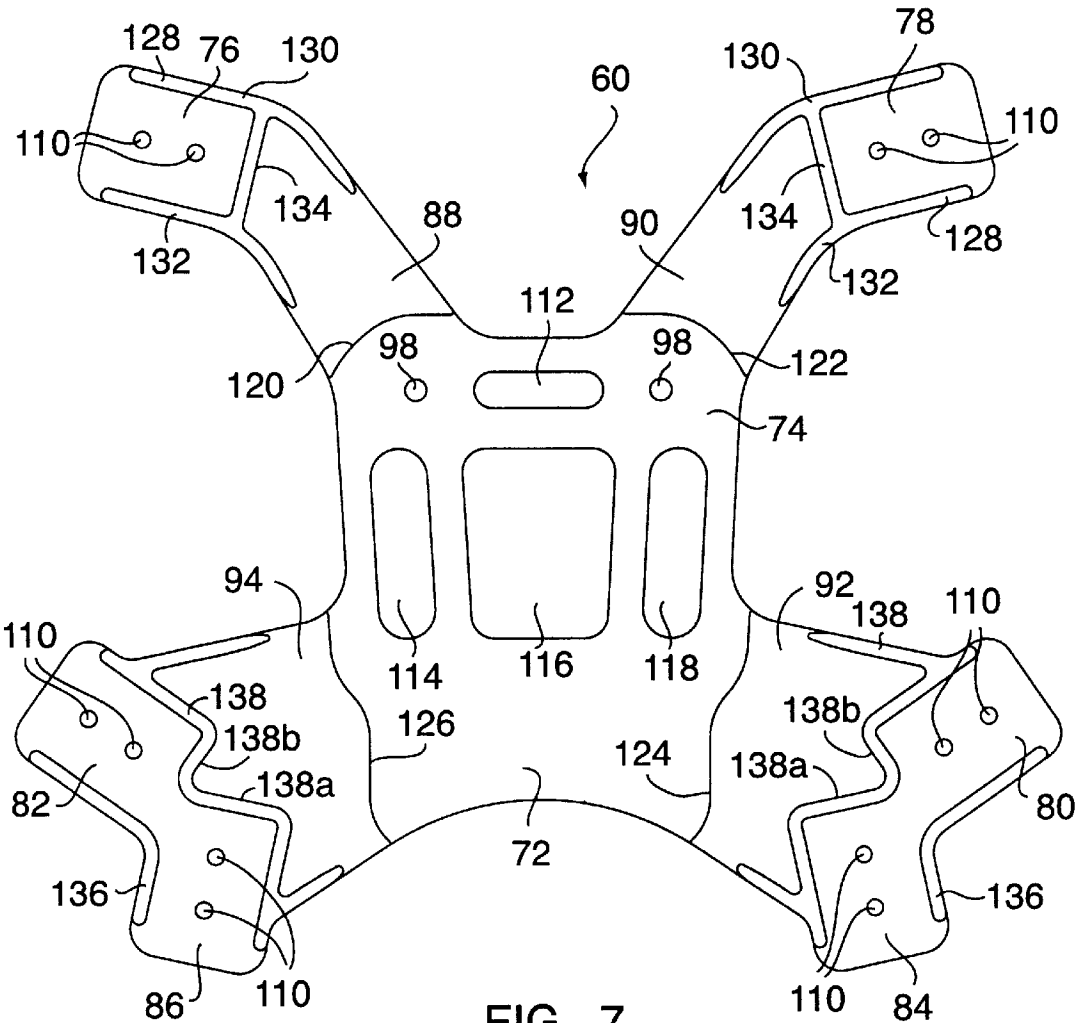
FIG. 7 is a bottom plan view of the body member of FIG. 6.

As best seen in FIG. 7, lower planar face 72 of central support area 74 of body member 60 is provided with a quartet of depressions or reliefs, namely: a centrally-located, substantially rectangular, horizontally oriented depression 112 disposed adjacent the upper edge of the central support area between through openings 98; and a trio of spaced, substantially-parallel, rectangular, vertically oriented depressions 114, 116 and 118 disposed below horizontal depression 112 all for purposes to appear.

Lower planar face 72 of body member 60 is also relieved or thinned at 120 and 122 at the bend points between central support area 74 and finger-like members 88 and 90 respectively, and is relieved or thinned at 124 and 126 at the bend points between central support area 74 and leg-like members 92 and 94 respectively, for purposes to appear.

Depressions and reliefs 112–116 and reliefs 120, 122 provide not only weight reduction, but also allow for easy flexing of central support area 74 of body member 60 and easy flexing of finger-like members 88 and 90 and leg-like members 92 and 94 relative to central support area 74.

Lower planar face 72 of each toe strap anchor support 76 and 78 is provided with an upstanding rib 128 of substantially H-shape comprising a pair of spaced ribs 130, 132 located at each side edge of each support 76 and 78 and a transverse cross rib 134 connecting between ribs 130 and 132 and spaced inwardly of and parallel to the outer edge of each anchor support.

Ribs 128 each serve as a combination guide, stop and restraint for the attachment of toe strap/instep strap assembly 62 to supports 76 and 78, as will appear.

Lower planar face 72 of instep strap anchor supports 80 and 82 and heel strap anchor supports 84 and 86 is provided with an upstanding outer rib 136 and an upstanding inner rib 138.

Outer rib 136 is located at and follows the contour of the outer side edge of instep strap anchor supports 80 and 82 and the outer side edge of heel strap anchor supports 84 and 86.

Inner rib 138 is disposed inwardly of and in spaced, substantial parallelism to outer rib 136, with the exception of a somewhat serpentine, L-shaped central portion which includes an offset first part, identified as 138*a*, disposed in spaced parallelism to a lower outer edge of each heel strap anchor support 84 and 86, and an offset second part, identified as 138*b*, disposed in spaced parallelism to an upper outer edge of each instep strap assembly anchor support 80 and 82.

Ribs 136, 138, 138*a* and 138*b* serve as combination guides, stops and restraints for the attachment of toe strap/instep strap assembly 62 and heel strap assembly 64 to supports 80, 82, 84 and 86, as will appear.

Figure 5:
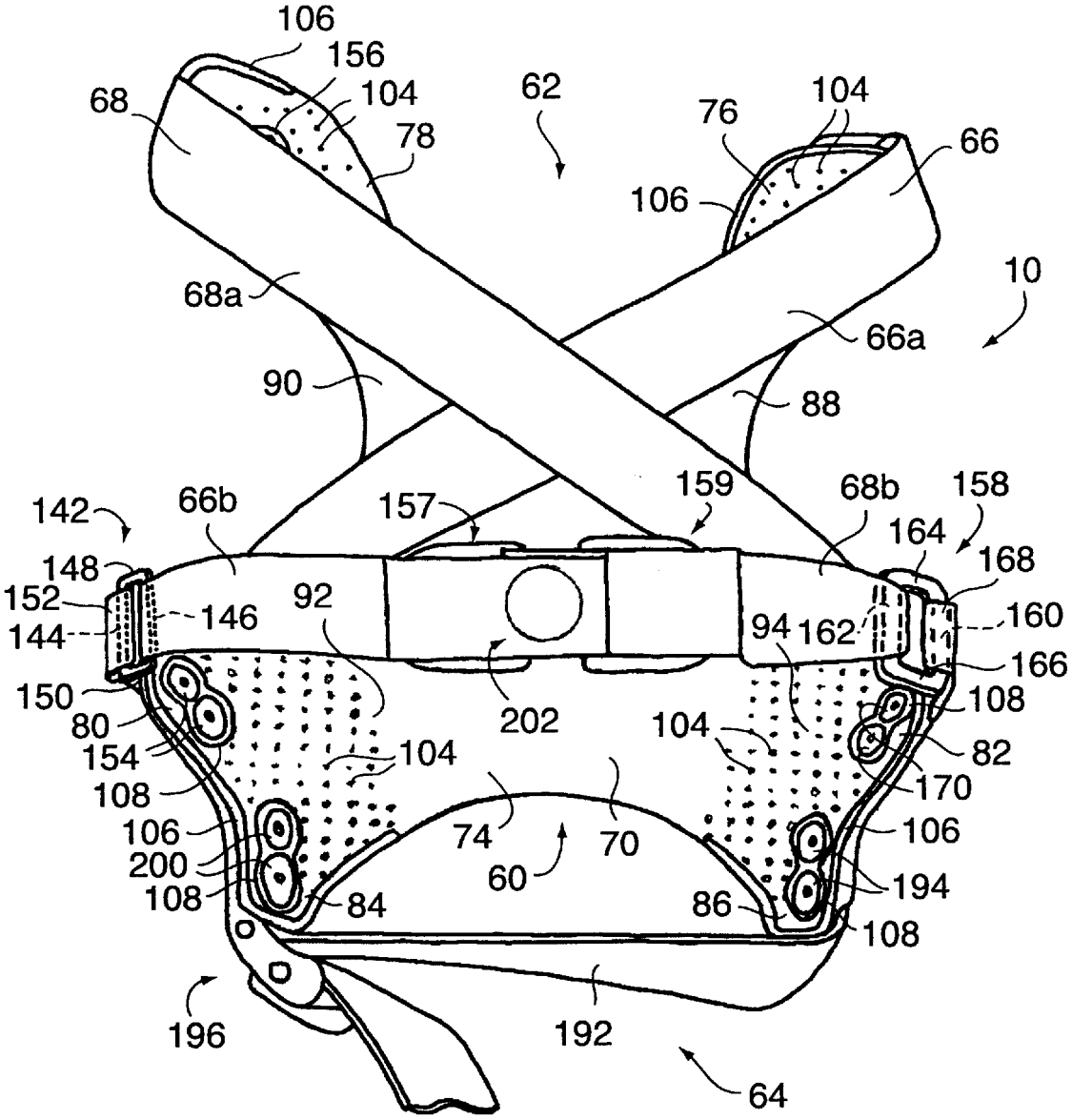
FIG. 5 is a top plan view of the binding of the invention, the instep binding straps being shown in an engaged or snapped condition.
Figure 6:
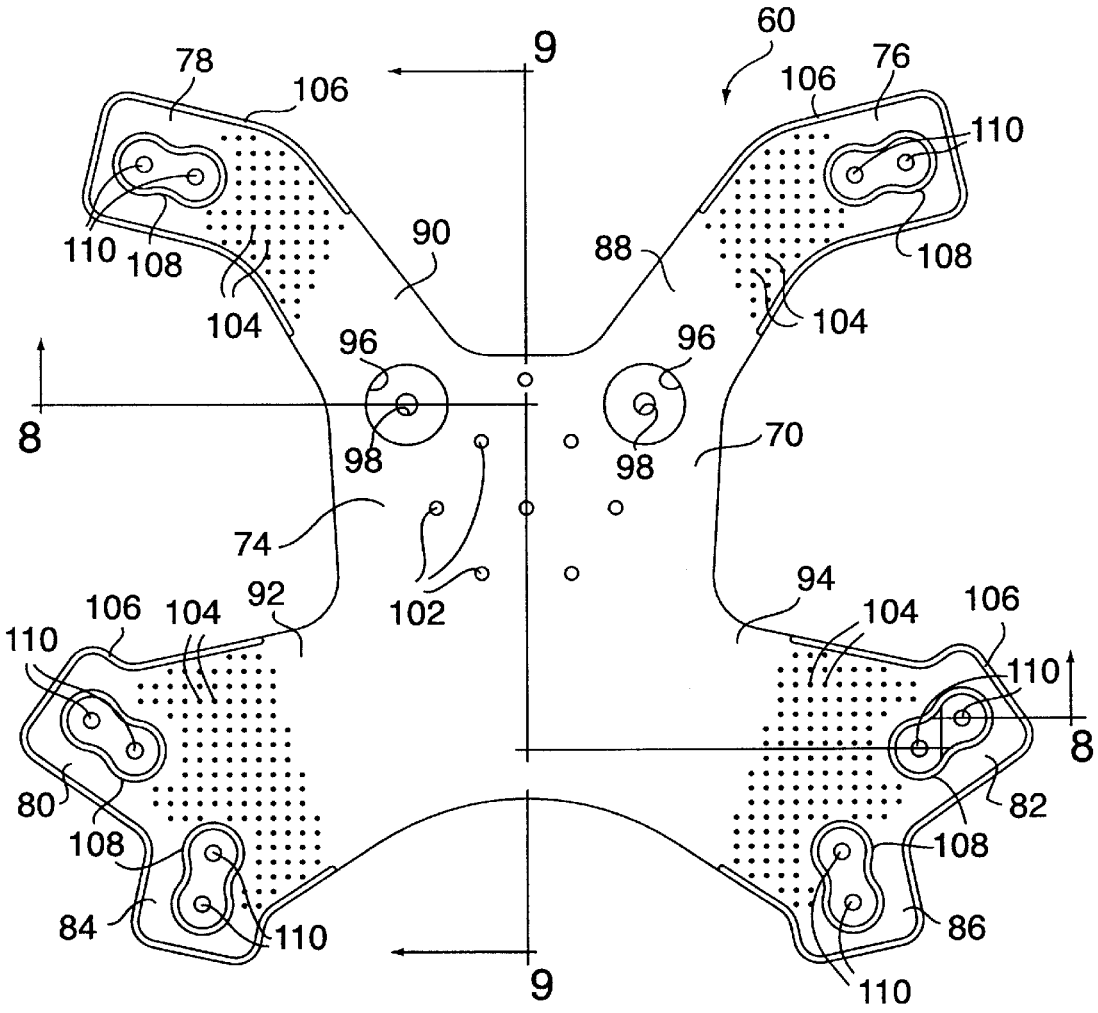
FIG. 6 is a top plan view of the body member of the binding of the invention, the body member being shown in a flat, or non-use, position.

As best seen in FIGS. 1 and 5, toe strap/instep strap assembly 62 includes first and second straps 66 and 68 respectively.

First strap 66 comprises a toe strap portion 66*a* and an instep strap portion 66*b*, with instep strap portion 66*b* constituting an integral, unitary extension of toe strap portion 66*a*.

Second strap 68 comprises a toe strap portion 68*a* and an instep strap portion 68*b*, with instep strap portion 68*b* constituting an integral, unitary extension of toe strap portion 68*a*.

Figure 3:
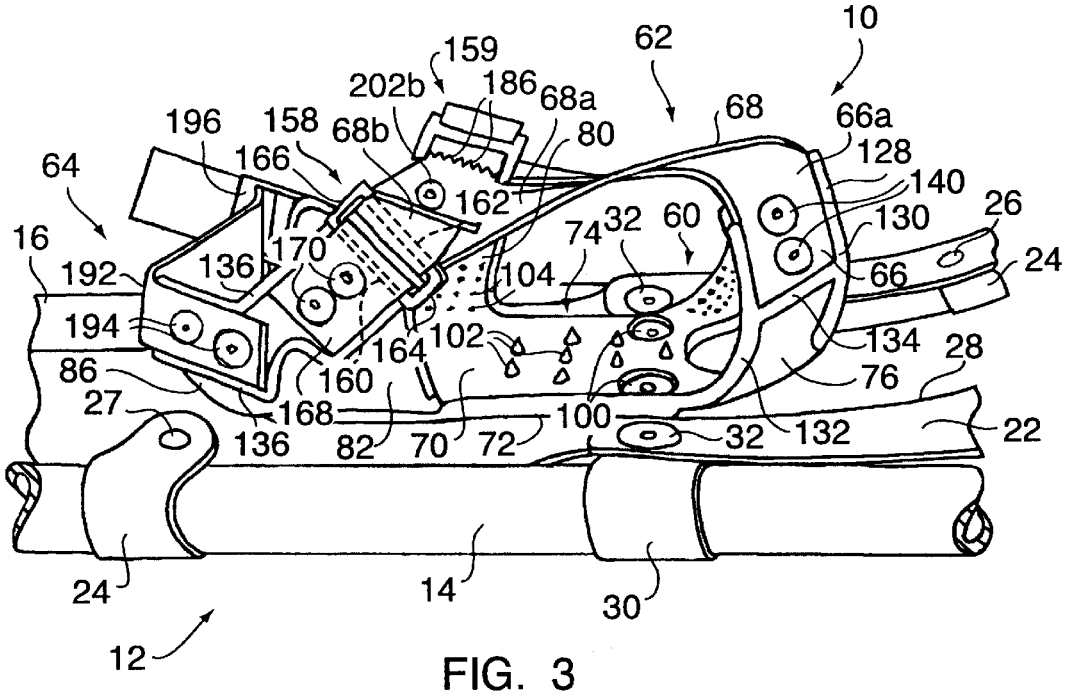
FIG. 3 is a fragmentary side perspective view of the binding of the invention as seen from the right of FIG. 1.

As best seen in FIG. 3, toe strap portion 66*a* of first strap 68 is fixed at one end to lower planar face 72 of first toe strap anchor support 76 as by rivets 140 which extend through the strap and through the openings in the support, with positioning of the strap end being facilitated by rib 128.

Positioning of the rivets 140 is facilitated by rib 108 on upper planar face 70 of anchor support 76.

Toe strap portion 66*a* of first strap 66 curves over the outer edge of support 76 and extends diagonally across body member 60 to first instep strap anchor support 80, where it passes through a first guide buckle generally indicated by 142.

First guide buckle 142 is of generally rectangular, open, parallelogram shape and Includes spaced, parallel first and second cross bars 144 and 146, respectively, the cross bars being interconnected at their ends by spaced parallel first and second side bars 148 and 150, respectively.

First guide buckle 142 is pivoted to the upper end of a strap 152, the lower ends of which are fixed to lower planar face 72 of first instep anchor support 80 as by rivets 154 which extend through the strap and through the openings 110 in the support, with positioning of the strap ends being facilitated by ribs 136 and 138 and positioning of the rivets being facilitated by rib 108 on anchor support 80. Strap 152 partially encircles first cross bar 144 of guide buckle 142 so that the guide buckle can pivot relative to the strap while being disposed upwardly of the outer end of first instep anchor support 80.

At first instep strap anchor support 80, toe strap portion 66*a* of first strap 66 passes through first guide buckle 142 and curves over second cross bar 146 thereof where it becomes instep strap portion 66*b* and extends transversely across body member 60 of binding 10 to and through a first ladder cinch buckle 157 which faces toward first guide buckle 142, where the strap reverses direction and continues back toward the first guide buckle.

Figure 4:
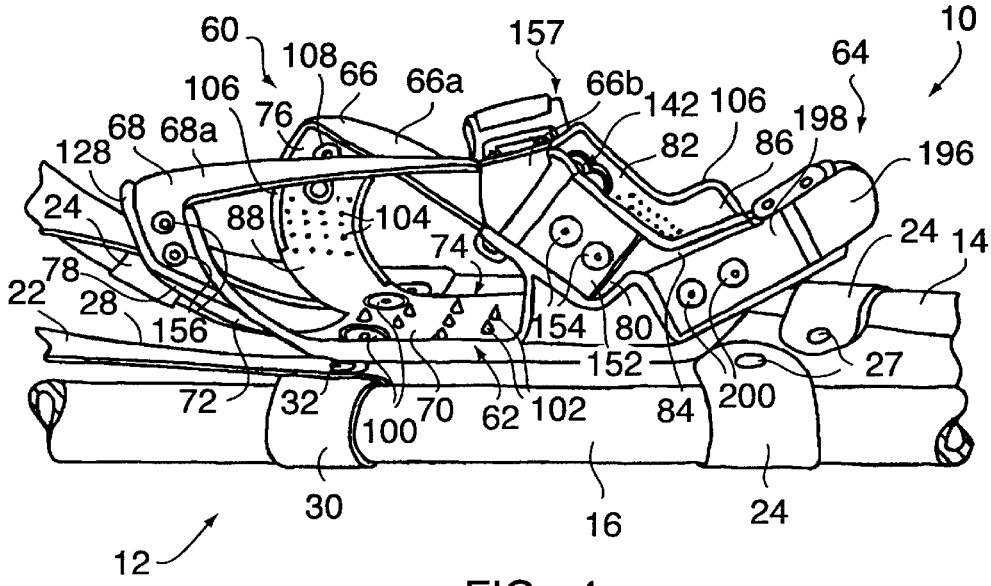
FIG. 4 is a fragmentary side perspective view of the binding of the invention as seen from the left of FIG. 1.

As best seen in FIG. 4, toe strap portion 68*a* of second strap 68 is fixed at one end to lower planar face 72 of second toe strap anchor support 78 as by rivets 156 which extend through the strap and through the openings in the support, with positioning of the strap end being facilitated by rib 128.

Positioning of the rivets 156 is facilitated by rib 108 on upper planar face 70 of anchor support 78.

Toe strap portion 68*a* curves over the outer edge of support 78 and extends diagonally across body 60 of binding 10, passing over toe strap portion 66*a* of first strap 66, to second instep strap anchor support 82, where it passes through a second guide buckle generally indicated by 158.

Second guide buckle 158 is identical to first guide buckle 142 and includes spaced, parallel, first and second cross bars 160 and 162 respectively, which are interconnected at their ends by spaced, parallel first and second side bars 164 and 166 respectively.

Second guide buckle 158 is pivoted to the upper end of a strap 168, the lower ends of which are fixed to lower planar face 72 of second instep strap anchor support 82 as by rivets 170 which extend through the strap and through the openings 110 in the support, with positioning of the strap ends being facilitated by ribs 136 and 138 and positioning of the rivets being facilitated by rib 108 on anchor support 82. Strap 168 partially encircles first cross bar 160 of guide buckle 158 so that the guide buckle can pivot relative to the strap while being disposed upwardly of the outer end of second instep strap anchor support 82.

At second instep strap anchor support 82, toe strap portion 68*a* of second strap 68 passes through second guide buckle 158 and curves over second cross bar 162 thereof where it becomes instep strap portion 68*b* and extends transversely across body member 60 of binding 10 to and through a second ladder cinch buckle 159 disposed adjacent first ladder cinch buckle 157 but facing oppositely therefrom, where the strap reverses direction and continues back toward second guide buckle 158.

First and second ladder cinch buckles 157 and 159 respectively are oppositely facing and are positioned centrally of body member 60 of binding 10 between first and second instep strap anchor supports 80 and 82 respectively.

Figure 12:
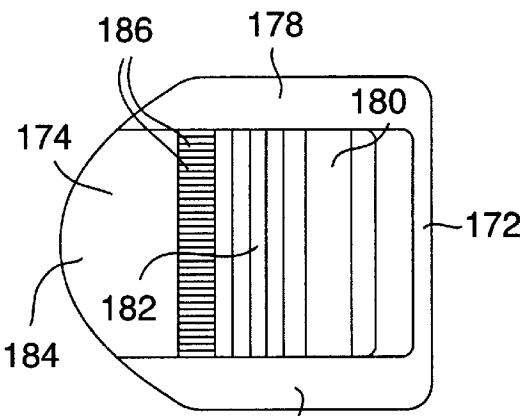
FIG. 12 is a bottom plan view of the ladder cinch buckle of FIG. 11.
Figure 11:
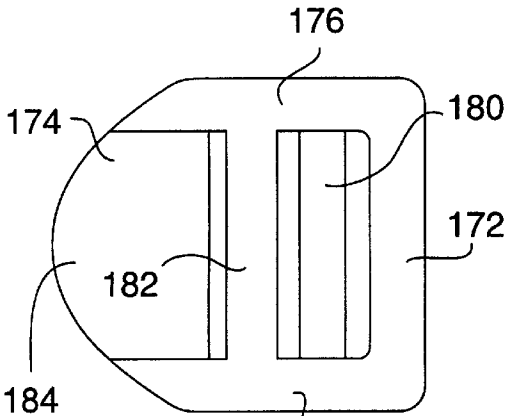
FIG. 11 is a top plan view of one of the ladder cinch buckles of the binding of the invention.
Figure 13:
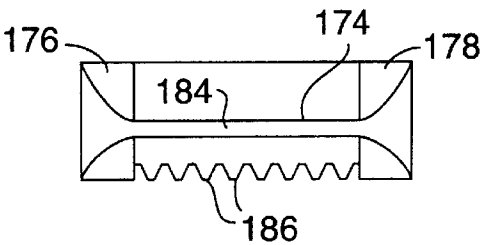
FIG. 13 is an end elevational view of the ladder cinch buckle of FIG. 11, as seen from the left.

Ladder cinch buckles 157 and 159 are identical and, as best seen in FIGS. 11–13, each comprises an open, rectangular body having a pair of spaced, parallel longitudinally-extending outer walls 172 and 174 which are interconnected by a pair of spaced parallel, transversely-extending end walls 176 and 178.

A pair of spaced, inner walls 180 and 182 extend between end walls 176 and 178 and are disposed in spaced parallelism to outer walls 172 and 174.

The upper surface of outer wall 174 has a tab 184 extending horizontally outwardly therefrom, while the lower surface of outer wall 174 is provided with a series of spaced teeth 186.

Tabs 184 of ladder cinch buckles 157 and 159 may be grasped by the fingers of a user to manipulate the buckles, while teeth 186 may impinge in locking manner on instep strap portions 66*b* and 68*b* of first and second straps 66 and 68, as will appear.

Figure 10:
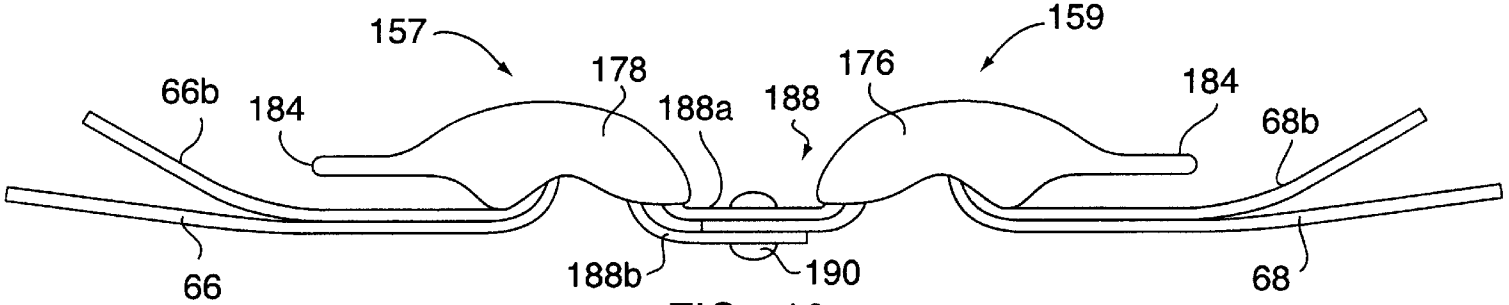
FIG. 10 is a fragmentary, front elevational view of the dual buckle and strap system of the binding of the invention.

As best seen in FIGS. 1 and 10, a strap 188 connects between ladder cinch buckles 157 and 159, the strap having an upper run 188*a* with opposite free ends, with each end extending under outer wall 172 and over and then back under inner wall 180 and under outer wall 172 of each cinch buckle to form a lower run 188*b* disposed below upper run 188*a*.

Strap upper and lower runs 188*a* and 188*b* are joined together by a pair of rivets 190 which extend therethrough, the rivets being located centrally between cinch buckles 157 and 159.

Strap 188, while joining the cinch buckles 157 and 159, permits each buckle to be freely manipulated and each buckle to have independent, pivotal movement free of the other.

Instep strap portion 66*b* of first strap 66 extends from first guide buckle 142 to first ladder cinch buckle 157, where a strap free end passes under and then over inner wall 182 and under teeth 186 of outer wall 174 of the cinch buckle back toward first guide buckle 142.

Instep strap portion 68*b* of second strap 68 extends from second guide buckle 158 to second ladder cinch buckle 159, where a strap free end passes under and then over inner wall 182 and under teeth 186 of outer wall 174 of the cinch buckle back toward second buckle 158.

Heel strap assembly 64 includes a heel strap 192 which is fixed at one end to second heel strap anchor support 86 by a pair of rivets 194 with positioning of the strap end being facilitated by ribs 136 and 138 and positioning of the rivets being facilitated by rib 108 on anchor support 86. Heel strap 192 has an opposite free end releasably engaged in a cam buckle 196 pivotally mounted on the outer end of a strap 198, the lower ends of which are fixed by rivets 200 to first heel anchor support 84, with positioning of the strap ends being facilitated by ribs 136 and 138 and positioning of the rivets being facilitated by rib 108 on anchor support 84. Buckle 196 extends upwardly from the anchor support for easy manipulation and insertion or removal of strap 192 therefrom.

Following the installation of toe strap/instep strap assembly 62 and heel strap assembly 64 onto their respective anchor supports on body member 60 of binding 10 and of instep strap portions 66*b* and 68*b* into ladder cinch buckles 157 and 159 respectively, snap hardware, generally indicated by 202, is added.

Snap hardware 202 comprises a snap fastener 202*a* fixed to instep strap portion 66*b* adjacent a free end of first strap 66 and a snap fastener receptor 202*b* fixed to instep strap portion 68*b* adjacent a free end of second strap 68.

When the free ends of straps 66 and 68 are brought together over ladder cinch buckles 157 and 159, as shown in FIG. 5, snap fastener 202*a* may be engaged in snap fastener receptor 202*b* to releasably lock the strap ends together.

When not interengaged, snap hardware parts 202*a* and 202*b* also serve as stops to preclude the removal of straps 66 and 68 from their respective cinch buckles.

Preassembled binding 10 is attached to snowshoe frame 12 by rivets 100 positioned in depressions 96 of central support area 74 of binding body 60, the rivets extending downwardly through openings 98 in the support area and through provided openings, not shown, in pivot strap 30 and toe crampon 34.

A unique feature of the binding design is its floating dual cinch buckle means 157 and 159 which "float" on instep strap portions 66*b* and 68*b* and are positioned for ready accessibility in an area over the instep of the boot of a user. The dual ladder cinch buckles 157 and 159 operate in opposite directions of up to 180°, with the angle changing somewhat depending on the boot size of the snowshoe user. The straps are permanently installed in the buckles, and are secured against removal by snap hardware 202 on the instep strap portions.

The binding is easily opened by placing the fingers under the tabs 184 of the cinch buckles and lifting upwardly. The boot is then placed in the binding, with the ball of the foot lined up with rivets 100 which serve as alignment means on the binding. The user pulls upwardly on the free ends of the two strap portions 66*b* and 68*b* to tighten the fit, and then pulls downwardly on the strap free ends to lock the binding. Heel strap 192 is then pulled snug, and held by cam buckle 196. Exit is achieved by placing the fingers under the tabs 184 and lifting upwardly in motions which are very similar to the tying of shoes. Heel strap 192 is then released by lifting the cam buckle and pulling on the strap.

The improvement lies in the design of the floating buckle system, which may be constructed of currently available, commercially purchased components, or which may be molded as a single component.

As a further unique feature, the opposing cinch buckles 157 and 159 are easily accessible at the instep of the boot of a snowshoe user and are not anchored to any supporting component on the body of the binding.

We claim:

1. A binding for releasably securing a boot of a user to a snowshoe comprising, a body member which conforms to the contour of the boot, combination toe and instep straps and a heel strap attached to the body member for engagement with the boot, and buckles for restraining the straps comprising, a pair of instep buckles and a heel buckle, the combination toe and instep straps being installed in the instep buckles, the instep buckles being operable in opposite directions and not being anchored to the body member, the heel buckle being anchored to the body member and the heel strap being installed therein.

2. A binding according to claim 1, wherein the instep buckles are operable in opposite directions of proximal 180°.

3. A binding according to claim 1, wherein the instep buckles are oppositely facing and the combination toe and instep straps incorporate means for precluding their removal from the instep buckles.

4. A binding according to claim 1, wherein the instep buckles are of a ladder cinch type.

5. A binding according to claim 1, wherein the heel buckle is of a cam type and the heel strap is releasably installed therein.

6. A binding according to claim 1, wherein there are pairs of combination toe and instep straps, with each instep strap constituting an integral unitary extension of a toe strap.

7. A binding according to claim 1, wherein the body member is fabricated from an elastomeric material and comprises, a central support area, pairs of toe strap anchor supports, instep strap anchor supports, and heel strap anchor supports emanating from said central support area, the toe straps, instep straps and heel strap being attached respectively to said toe strap anchor supports, instep anchor supports, and said heel strap anchor supports.

8. A binding according to claim 1, wherein the toe and instep straps incorporate snap hardware which, in a first mode, secure the toe and instep straps together and which, in a second mode, preclude the removal of the toe and instep straps from the instep buckles.

* * * * *